US008403636B2

(12) United States Patent
Dakowski et al.

(10) Patent No.: US 8,403,636 B2
(45) Date of Patent: Mar. 26, 2013

(54) TURBINE STAGE IN A TURBOMACHINE

(75) Inventors: Mathieu Dakowski, Sucy en Brie (FR); Claire Dorin, Maisons-Alfort (FR); Alain Dominique Gendraud, Vernou Lacelle sur Seine (FR); Vincent Philippot, Savigny le Temple (FR)

(73) Assignee: SNECMA, Paris (FR)

( * ) Notice: Subject to any disclaimer, the term of this patent is extended or adjusted under 35 U.S.C. 154(b) by 1158 days.

(21) Appl. No.: 12/038,422

(22) Filed: Feb. 27, 2008

(65) Prior Publication Data

US 2008/0206047 A1 Aug. 28, 2008

(30) Foreign Application Priority Data

Feb. 28, 2007 (FR) ..... 07 01426

(51) Int. Cl.
*F01D 9/04* (2006.01)

(52) U.S. Cl. ..... 415/173.1; 415/213.1

(58) Field of Classification Search ..... 415/173.1, 415/213.1
See application file for complete search history.

(56) References Cited

U.S. PATENT DOCUMENTS

| | | | | |
|---|---|---|---|---|
| 3,202,399 | A * | 8/1965 | Bar | 415/87 |
| 3,314,648 | A | 4/1967 | Howald | |
| 4,157,232 | A * | 6/1979 | Bobo et al. | 415/116 |
| 4,522,557 | A * | 6/1985 | Bouiller et al. | 415/115 |
| 4,529,355 | A * | 7/1985 | Wilkinson | 415/173.1 |
| 5,181,826 | A * | 1/1993 | Rock | 415/173.1 |
| 5,593,277 | A * | 1/1997 | Proctor et al. | 415/173.1 |
| 5,772,400 | A * | 6/1998 | Pellow | 415/173.1 |
| 6,131,384 | A * | 10/2000 | Ebel | 60/797 |
| 6,435,820 | B1 * | 8/2002 | Overberg | 415/138 |
| 6,726,446 | B2 * | 4/2004 | Arilla et al. | 415/138 |
| 6,823,676 | B2 * | 11/2004 | Conete et al. | 60/796 |
| 7,140,836 | B2 * | 11/2006 | Balsdon | 415/116 |
| 2005/0097899 | A1 * | 5/2005 | Lepretre | 60/785 |
| 2008/0206047 | A1 * | 8/2008 | Dakowski et al. | 415/182.1 |

FOREIGN PATENT DOCUMENTS

| | | |
|---|---|---|
| EP | 1 059 420 A1 | 12/2000 |
| EP | 1 408 200 A2 | 4/2004 |
| EP | 1 517 005 A1 | 3/2005 |
| FR | 2 887 939 | 1/2007 |

* cited by examiner

*Primary Examiner* — Edward Look
*Assistant Examiner* — Christopher R Legendre
(74) *Attorney, Agent, or Firm* — Oblon, Spivak, McClelland, Maier & Neustadt, L.L.P.

(57) ABSTRACT

A turbine stage in a turbomachine including ring sectors arranged about a turbine impeller, and an annular support supporting the ring sectors and attached to a turbine casing is disclosed. The annular support is able to be deformed elastically in the radial direction to cushion at least a portion of the deformations of the turbine casing in operation.

11 Claims, 2 Drawing Sheets

TURBINE STAGE IN A TURBOMACHINE

The present invention relates to a turbine stage in a turbomachine such as in particular an aircraft turbojet or turboprop.

BACKGROUND OF THE INVENTION

A turbomachine comprises several turbine stages each comprising an upstream guide vane element formed of an annular array of fixed stator blades and an impeller mounted rotatably downstream of the upstream guide vane element in a cylindrical or frustoconical shroud formed by ring sectors placed circumferentially end-to-end. The first of these stages is a high-pressure stage and the other stages situated downstream are low-pressure stages.

It is important that the radial clearances between the impellers and the corresponding ring sectors be optimized in order to enhance the performance of the turbomachine and to prevent any friction of the blade ends on the ring sectors, which would result in these ends wearing and in the performance of the turbomachine deteriorating at all operating speeds.

The ring sectors that surround the impeller of the high-pressure stage comprise, at their upstream and downstream ends, coupling means interacting with corresponding means provided on an annular support placed between the ring sectors and the turbine casing.

In operation, the hot gases leaving the combustion chamber of the turbomachine flow through the upstream guide vane element of the high-pressure stage and exert thereon an axial pressure in the downstream direction. This upstream guide vane element tends to move in the downstream direction and to press via its outer periphery on the annular support of the ring sectors and to push it in the downstream direction, which causes variations of the radial clearances between the movable blades of the impeller and the ring sectors.

DESCRIPTION OF THE PRIOR ART

One solution to this problem consists in stiffening the annular support by forming it in a single piece with a support casing situated downstream of the ring sectors and making it possible to suspend the upstream guide vane element of the first, low-pressure stage from the turbine casing.

However, this solution has many disadvantages. The annular support and the ring sectors are fixedly connected to the support casing. It is therefore not possible to optimize the radial clearances between the movable blades and the ring sectors according to the speed of the turbomachine. In addition, the turbine casing is subjected in operation to nonuniform cooling air flows on its periphery which cause considerable temperature gradients to appear on the casing, which causes deformations of the casing called "carcass distortions", and result in movements of the support casing and of the ring sectors coupled to the annular support. The movements of the ring sectors are random and uncontrolled and cause variations of the radial clearances between the movable blades and the ring sectors of the high-pressure stage which reduce the performance of the turbomachine.

Another solution to the aforementioned problem consists in fixing the support directly to the turbine casing. However, this solution is also unsatisfactory because, to ensure good axial rigidity of this support, its attachment means usually have a very great axial space requirement. Furthermore, this solution does not make it possible to solve the problems of movements of the ring sectors associated with the carcass distortions of the turbine casing.

SUMMARY OF THE INVENTION

The main object of the invention is to provide a simple, effective and economical solution to all the problems of the prior art.

Accordingly it proposes a turbine stage in a turbomachine, comprising ring sectors arranged about an impeller and suspended from a turbine casing by an annular support, wherein the annular support comprises means for coupling the ring sectors and means for attachment to the turbine casing, connected by two coaxial annular walls connected to one another and extending one inside the other, this support having a V-shaped or U-shaped section and being able to be elastically deformed in a radial direction to absorb at least a portion of the deformations of the turbine casing in operation.

According to the invention, the ring sectors are suspended from the turbine casing by an annular support that can be deformed in the radial direction so as to absorb at least a portion of the carcass distortions of the outer casing so that the shroud formed by the ring sectors retains a substantially constant diameter in operation. The invention makes it possible to maintain a substantially constant radial clearance between the impeller and the ring sectors of the high-pressure stage, and at the leading and trailing edges of the movable blades of this impeller. The annular support also has a good axial rigidity so that it can withstand, without deforming, the axial pressure from the upstream side of the upstream guide vane element of the high-pressure stage subjected to the pressure of the combustion gases.

The elastically deformable support comprises two coaxial annular walls connected to one another and extending one inside the other, this support having a V-shaped or U-shaped section with an apex oriented in the upstream or downstream direction.

In operation, the two coaxial walls of the support may move closer together or further apart to cushion the carcass distortions of the turbine casing. The junction between the two walls is formed in order to deform elastically and provide the support with a spring function. This dual-wall structure also makes it possible to enhance the axial rigidity of the support of the ring sectors.

According to a first embodiment of the invention, the annular support has a V-shaped section and comprises two frustoconical walls, respectively inner and outer. The inner frustoconical wall may for example extend from means for coupling the ring sectors radially outward and in the upstream direction up to the outer frustoconical wall which extends radially outward and in the downstream direction. In this case, the support defines an annular groove which opens axially in the downstream direction.

According to a second embodiment of the invention, the annular support has a U-shaped section and comprises two substantially cylindrical walls, respectively inner and outer. The inner cylindrical wall may be connected at its upstream end to means for coupling the ring sectors and, at its downstream end, to the downstream end of the outer cylindrical wall. In this instance the support defines an annular groove oriented axially in the upstream direction.

Preferably, the outer wall comprises a radially outer annular flange for attachment to the turbine casing.

Advantageously, the inner wall is connected to an upstream end of the means for coupling the ring sectors so as to enhance the axial rigidity of the support.

The junction between the inner and outer walls may have a curved C shape defining a concave annular surface and a convex annular surface. This junction advantageously comprises an annular rib extending substantially axially from its convex annular surface in order to stiffen the zone of junction of the two walls and spread the stresses in this zone. This annular rib is for example of cylindrical shape centered on the axis of revolution of the support.

The present invention also relates to a turbomachine turbine and a turbomachine, such as an aircraft turbojet or turboprop, comprising at least one stage as described above.

The invention also relates to an annular support of ring sectors in a turbine stage of a turbomachine, which has a U-shaped or V-shaped section and comprises, at its inner periphery, means for coupling the ring sectors, and, at its outer periphery, a radially outer annular flange.

BRIEF DESCRIPTION OF THE DRAWINGS

The invention will be better understood and other features, details and advantages of the latter will appear more clearly on reading the following description, made as a nonlimiting example and with reference to the appended drawings in which.

DESCRIPTION OF THE PREFERRED EMBODIMENTS

Figure 1:
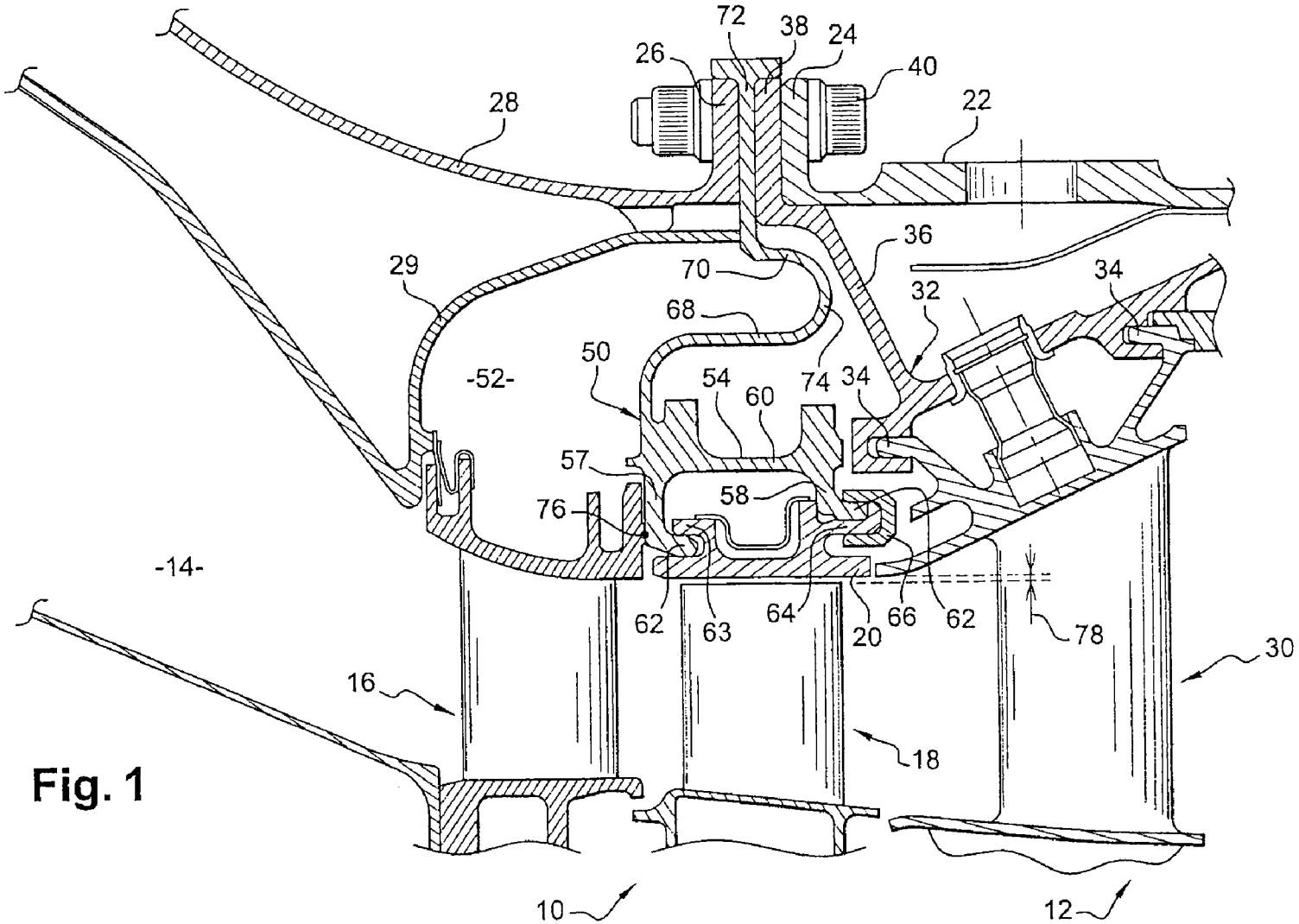
FIG. 1 is a partial schematic axisymmetric cross-sectional view of a device for attaching ring sectors according to the invention.

FIG. 1 represents schematically a portion of a turbomachine such as an aircraft turbojet or turboprop comprising a turbine arranged downstream of a combustion chamber 14, this turbine comprising several stages: an upstream stage, or high-pressure stage 10 and downstream stages or low-pressure stages 12.

The high-pressure stage 10 comprises an upstream guide vane element 16 formed of an annular array of fixed stator blades, and an impeller 18 mounted downstream of the upstream guide vane element 16 and rotating in a substantially cylindrical shroud formed by ring sectors 20 placed circumferentially end-to-end and suspended from a turbine casing 22.

Each low-pressure stage 12 also comprises an upstream guide vane element and an impeller of the aforementioned type, only the upstream guide vane element 30 of the first low-pressure stage being visible in FIG. 1. This upstream guide vane element 30 is attached to the turbine casing 22 by means of an annular supporting part 32 arranged between the upstream guide vane element 30 and the casing 22. The supporting part 32 comprises, at its radially inner end, annular grooves which open in the downstream direction and in which are engaged circumferential rims 34 provided on the outer periphery of the upstream guide vane element. The part 32 comprises a frustoconical wall 36 which extends radially outward and in the upstream direction and is connected, at its radially outer end, to a radially outer annular flange 38 for attachment to a corresponding annular flange 24 provided at the upstream end of the turbine casing 22.

An outer casing 28 surrounding the combustion chamber 14 is also provided at its downstream end with a radially outer annular flange 26 that is kept axially clamped on the flanges 38 and 24 of the supporting part 32 and of the turbine casing 22 via means 40 of the screw-nut type. The combustion chamber 14 is attached to the outer casing 28 by means of an annular wall 29 extending from the downstream end of the chamber radially outward and in the downstream direction and comprising at its radially outer end means for attachment to the outer casing 28.

The ring sectors 20 are suspended from the turbine casing 22 by means of an annular support 50 that is housed in an annular enclosure 52 delimited, in the upstream direction, by the annular wall 29 of the combustion chamber 14 and, in the downstream direction, by the frustoconical wall 36 of the supporting part 32. This annular support comprises, at its inner periphery, means 54 for coupling of the ring sectors 20 and, at its outer periphery, means 72 for attachment to the turbine casing 22.

According to the invention, this annular support 50 can be deformed elastically in the radial direction to cushion at least partly the carcass distortions to which the turbine casing 22 is subjected in operation of the turbomachine, so that the cylindrical shroud formed by the ring sectors 20 retains a substantially constant diameter.

The annular support 50 comprises, at its inner periphery, two radial annular walls 57, 58, respectively upstream and downstream, that are connected to one another by a cylindrical wall 60. The radial walls 57, 58 comprise, at their radially inner ends, cylindrical rims 62 oriented in the downstream direction that interact with circumferential hooks 63, 64 provided at the upstream and downstream ends of the ring sectors 20. An annular locking member 66 with a C section is engaged axially from the downstream direction on the cylindrical downstream rim 62 of the support and on the downstream hooks 64 of the ring sectors to lock the assembly.

In FIG. 1, the mid-portion of the annular support 50 is elastically deformable in the radial direction and has a U-shaped section whose base is oriented in the downstream direction, this portion comprising two coaxial cylindrical walls 68, 70 extending one inside the other and connected to one another at their downstream end.

The inner cylindrical wall 68 extends about the cylindrical wall 60 of the coupling means, at a distance from the latter, and is connected at its upstream end to the radially outer end of the upstream radial wall 57 of the coupling means. The downstream end of the inner wall 68 is connected to the downstream end of the outer cylindrical wall 70 which has a smaller axial dimension than that of the inner wall 68 and which extends about a downstream portion of the inner wall 68, at a distance from the latter. The junction 74 between the inner wall 68 and outer wall 70 has a curved C shape. The upstream end of the outer wall 70 is connected to a radially outer annular flange 72 that is clamped between the flange 26 of the outer casing 28 and the flanges 38, 24 of the supporting part 32 and of the turbine casing 22.

In operation of the turbomachine, the casings 28 and 22 are not ventilated and cooled in a uniform manner on their periphery which generates considerable temperature gradients on these casings and results in carcass distortions. The annular support 50 for attachment of the ring sectors 20 makes it possible to cushion these distortions by elastic deformation of its mid-portion in the radial direction. This deformation results in bringing the walls 68, 70 closer together or moving them further apart in the radial direction. This support is sufficiently rigid in the axial direction to be able to resist, without deforming, the axial pressure exerted from the upstream side by the upstream guide vane element 16 of the high-pressure stage, this upstream guide vane element pressing at 76 via its outer periphery on the upstream face of the upstream radial wall 57 of the support. The radial clearances 78 between the blades of the impeller 18 and the ring sectors 20 may therefore be precisely adjusted, in particular according to the different operating speeds of the turbomachine.

Figure 2:
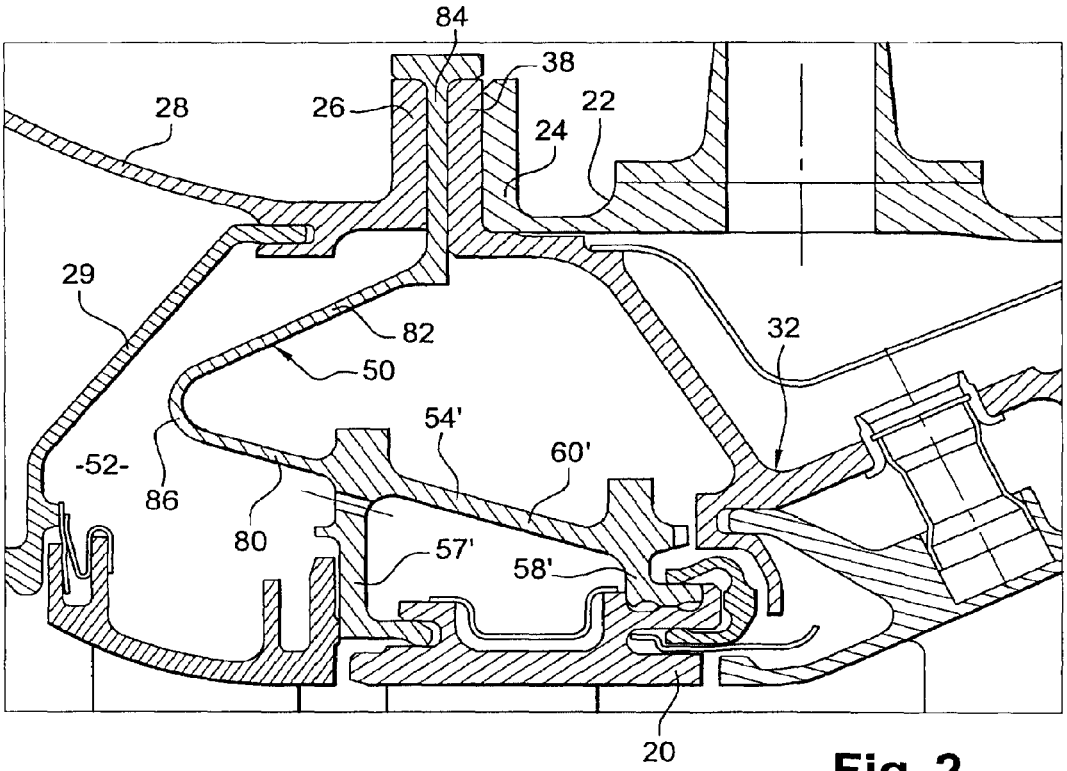
FIG. 2 is a partial schematic axisymmetric cross-sectional view of a variant embodiment of the attachment device according to the invention.

FIG. 2 shows a variant embodiment of the invention in which the elastically deformable mid-portion of the annular support 50 has a biconical shape and has a V-shaped section whose point is oriented in the upstream direction. This portion comprises two coaxial frustoconical walls 80, 82 extending one inside the other and connected to one another at their upstream ends.

The inner frustoconical wall 80 extends from the radially outer end of the upstream radial wall 57' of the coupling means 54', radially in the outward and upstream directions, that is to say upstream of the coupling means 54'.

The radially outer end of the inner wall 80 is connected to the radially inner end of the outer frustoconical wall 82 which extends radially outward and in the downstream direction about the inner wall 80. The outer wall 82 is connected, at its downstream end, to a radially outer annular flange 84 which is clamped axially between the flange 26 of the outer casing 28 and the flanges 38, 24 of the supporting part 32 and of the turbine casing 22. The junction 86 between the inner wall 80 and outer wall 82 has a curved C shape and defines, in the upstream direction, a convex annular surface and, in the downstream direction, a concave annular surface.

The upstream radial wall 57' and downstream radial wall 58' of the coupling means 54' are in this instance connected together by a frustoconical wall 60' that is aligned with the inner frustoconical wall 80 of the support to increase its axial rigidity.

Figure 3:
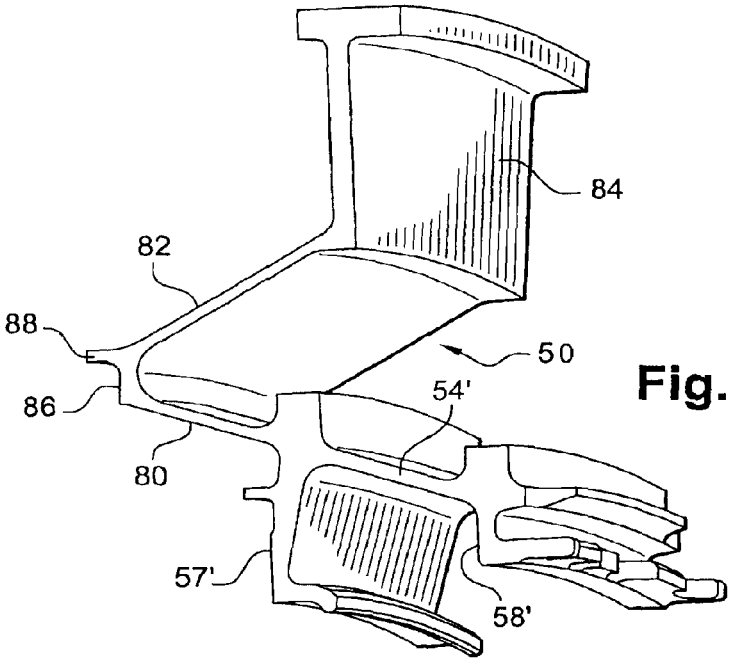
FIG. 3 is a partial schematic view in perspective of another variant embodiment of the attachment device according to the invention.

FIG. 3 shows another variant embodiment of the device according to the invention which differs from that of FIG. 2 in that it comprises a cylindrical rib 88 which extends axially in the upstream direction from the radial annular surface of the junction 86 of the inner and outer walls of the support. This rib 88 makes it possible to stiffen the zone of junction of the two walls and to spread the stresses in this zone.

The invention claimed is:

1. A turbine stage in a turbomachine, comprising:

ring sectors arranged about a turbine impeller and suspended from a turbine casing by an annular support, wherein the annular support comprises a coupling device which couples the ring sectors and means for attachment to the turbine casing, connected by two coaxial annular walls connected to each other, one of said walls being located radially inward of the other, respectively inner and outer, the annular support having a V-shaped or U-shaped section and being able to be elastically deformed in a radial direction to absorb at least a portion of the deformations of the turbine casing in operation, wherein the annular support is formed in a single piece, wherein the coupling device includes two radial annular walls, respectively upstream and downstream, that are connected to one another by a cylindrical or frustoconical connecting wall, said inner annular wall being connected to a radially outer end of the upstream radial annular wall, wherein the inner annular wall of the two coaxial annular walls extends from the coupling device radially outward and in an upstream direction up to the outer annular wall of the two coaxial annular walls which extends radially outward and in a downstream direction, and wherein the inner annular wall of the two coaxial annular walls is aligned with the connecting wall of the coupling device.

2. The turbine stage as claimed in claim 1, wherein the annular support has a V-shaped section and the inner and outer walls are frustoconical.

3. The turbine stage as claimed in claim 1, wherein the outer annular wall comprises a radially outer annular flange for attachment to the turbine casing.

4. The turbine stage as claimed in claim 1, wherein the radial annular walls comprise, at radially inner ends, cylindrical rims which are oriented in the downstream direction and which are configured to interact with upstream and downstream hooks provided at the ring sector, an annular locking member with a C section being engaged axially on the cylindrical rim of the downstream radial annular wall and on the downstream hook of the ring sector to lock the assembly.

5. The turbine stage as claimed in claim 1, wherein a junction between the inner and outer annular walls has a curved C shape defining a concave annular surface and a convex annular surface.

6. The turbine stage as claimed in claim 5, wherein the junction comprises an annular rib extending substantially axially from its convex annular surface.

7. The turbine stage as claimed in claim 6, wherein the annular rib is of cylindrical shape centered on an axis of revolution of the annular support.

8. The turbine stage as claimed in claim 1, wherein an axial length of the inner annular wall is less than an axial length of the outer annular wall.

9. An annular support for ring sectors in a turbine stage of a turbomachine, comprising:

a coupling device which couples the ring sectors at an inner periphery of the annular support;

a radially outer annular flange at an outer periphery of the annular support; and two coaxial annular walls, respectively inner and outer, which are connected to each other and which connect the coupling device to the radially outer annular flange, one of said walls being located radially inward of the other, wherein the annular support has a U-shaped or V-shaped section, wherein the annular support is formed in a single piece, wherein the coupling device includes two radial annular walls, respectively upstream and downstream, that are connected to one another by a cylindrical or frustoconical connecting wall, said inner annular wall being connected to a radially outer end of the upstream radial annular wall, wherein the inner annular wall of the two coaxial annular walls extends from the coupling device radially outward and in an upstream direction up to the outer annular wall of the two coaxial annular walls which extends radially outward and in a downstream direction, and wherein the inner annular wall of the two coaxial annular walls is aligned with the connecting wall of the coupling device.

10. A turbine stage in a turbomachine, comprising:

ring sectors arranged about a turbine impeller and suspended from a turbine casing by an annular support, wherein the annular support comprises a coupling device which couples the ring sectors and means for attachment to the turbine casing, connected by two coaxial annular walls connected to each other, respectively inner and outer, one of said walls being located radially inward of the other, the annular support having a V-shaped or U-shaped section and being able to be elastically deformed in a radial direction to absorb at least a portion of the deformations of the turbine casing in operation, wherein the coupling device includes two radial annular walls, respectively upstream and downstream, that are connected to one another by a cylindrical or frustoconical connecting wall, said inner annular wall being connected to a radially outer end of the upstream radial annular wall, wherein the radial annular walls comprise, at radially inner ends, cylindrical rims which are oriented in the downstream direction and which are configured to interact with upstream and downstream hooks provided at the ring sector, an annular locking member with a C section being engaged axially on the cylindrical rim of the downstream radial annular wall and on the downstream hook of the ring sector to lock the assembly, wherein the inner annular wall of the two coaxial annular walls extends from the coupling device radially outward and in an upstream direction up to the outer annular wall of the two coaxial annular walls which extends radially outward and in a downstream direction, and wherein the inner annular wall of the two coaxial annular walls is aligned with the connecting wall of the coupling device.

11. A turbine stage in a turbomachine, comprising:

ring sectors arranged about a turbine impeller and suspended from a turbine casing by an annular support, wherein the annular support comprises a coupling device which couples the ring sectors and means for attachment to the turbine casing, connected by two coaxial annular walls connected to each other, respectively inner and outer, one of said walls being located radially inward of the other, the annular support having a V-shaped or U-shaped section and being able to be elastically deformed in a radial direction to absorb at least a portion of the deformations of the turbine casing in operation, wherein the coupling device includes two radial annular walls, respectively upstream and downstream, that are connected to one another by a cylindrical or frustoconical connecting wall, said inner annular wall being connected to a radially outer end of the upstream radial annular wall, wherein a junction between the inner and outer annular walls has a curved C shape defining a concave annular surface and a convex annular surface, wherein the inner annular wall of the two coaxial annular walls extends from the coupling device radially outward and in an upstream direction up to the outer annular wall of the two coaxial annular walls which extends radially outward and in a downstream direction, and wherein the inner annular wall of the two coaxial annular walls is aligned with the connecting wall of the coupling device.

* * * * *